US006670533B1

(12) United States Patent
Yeh

(10) Patent No.: US 6,670,533 B1
(45) Date of Patent: Dec. 30, 2003

(54) SHOULDER REST FOR VIOLIN OR THE LIKE CAPABLE OF IMPROVING TONE QUALITY

(75) Inventor: Daniel Yeh, Taipei (TW)

(73) Assignee: Otto Musica Corp., Taipei (TW)

( * ) Notice: Subject to any disclaimer, the term of this patent is extended or adjusted under 35 U.S.C. 154(b) by 0 days.

(21) Appl. No.: 10/430,334

(22) Filed: May 7, 2003

(51) Int. Cl.[7] ..... G10D 1/02
(52) U.S. Cl. ..... 84/278; 84/279
(58) Field of Search ..... 84/278, 274, 276, 84/279, 280, 281

(56) References Cited

U.S. PATENT DOCUMENTS 4,389,916 A * 6/1983 Ruthstrom ..... 84/278
5,208,409 A * 5/1993 Roulet ..... 84/278
5,731,531 A * 3/1998 Kun ..... 84/280
6,031,163 A * 2/2000 Cullum et al. ..... 84/279
6,369,303 B1 * 4/2002 Hvezda ..... 84/278

* cited by examiner

*Primary Examiner*—Kimberly Lockett
(74) *Attorney, Agent, or Firm*—Troxell Law Office PLLC

(57) ABSTRACT

A shoulder rest for violin or the like capable of improving tone quality includes at least an elongated base and binding elements provided at two upper outer ends of the elongated base for fixing the latter to a back of a violin or the like. The elongated base is provided with a plurality of spaced and differently sized through holes corresponding to a plurality of bass and treble strings provided at a top of the violin or the like, and can therefore resonate with the strings to make the musical sound produced by playing the violin or the like even more sonorous and sweeter.

3 Claims, 4 Drawing Sheets

SHOULDER REST FOR VIOLIN OR THE LIKE CAPABLE OF IMPROVING TONE QUALITY

FIELD OF THE INVENTION

The present invention relates to a shoulder rest for violin or the like capable of improving tone quality, and more particularly to a shoulder rest that is fixed to a back of a string instrument, such as a violin or the like, and is able make the musical sound produced by playing the violin or the like even more sonorous and sweeter.

BACKGROUND OF THE INVENTION

A violin player would usually rest a rear end of the violin on one shoulder bone to bear one chin against the violin while playing it. To reduce the discomfort at the shoulder area being compressed by a hard body of the violin, it is a common practice to place a shoulder rest at a lower rear end of the violin.

Such shoulder rest for violin or the like basically includes an elongated base configured for fitly bearing against the player's shoulder bone, and two spaced binding elements provided at two upper outer ends of the elongated base. The binding elements are separately tightened to outer edges of the violin or the like near the rear end thereof to fixedly connect the shoulder rest to the violin. To enable an ideal timbre effect, the elongated base is generally made of a wooden material, such as rose wood. Meanwhile, since a lower surface of the elongated base is directly pressed against the player's shoulder bone area, it is a common practice to fixedly attach a layer of air-permeable soft pad to the lower surface of the base, so that the shoulder rest is more comfortable for use.

To match with different configurations of violins or the like, as well as players' different preferences, the two spaced binding elements provided on the elongated bases of most currently available shoulder rests have adjusting means assembled thereto in advance, so that the two binding elements may be adjusted to space from each other by different distances depending on the body configuration of the violin or the like and the actual needs in use.

Canadian Patent No. 2,262,290 granted to Farha and owned by Canadian firm of The Kun Shoulder Rest Inc. discloses a separating device for the binding elements disclosed in Canadian Patent No. 1,290,961 granted to Kun.

However, most existing shoulder rests for violin or the like are designed to enable easy association with the body of the violin or the like and easy adjustment of a distance between the binding elements. All these designs are obviously of little help in terms of the function of violin or the like.

SUMMARY OF THE INVENTION

A primary object of the present invention is to provide a shoulder rest for violin or the like that is able to resonate with strings of the violin or the like and thereby making the musical sound produced by playing the violin or the like has even more sonorous and sweeter tone quality.

To achieve the above and other objects, the shoulder rest for violin or the like according to the present invention includes at least one elongated base, and binding elements provided at two upper outer ends of the elongated base for fixing the latter to a back of the violin or the like. The elongated base is provided with a plurality of differently sized through holes corresponding to a plurality of strings provided on a top of the violin or the like, and the through holes corresponding to bass strings are diametrically larger than the through holes corresponding to treble strings.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
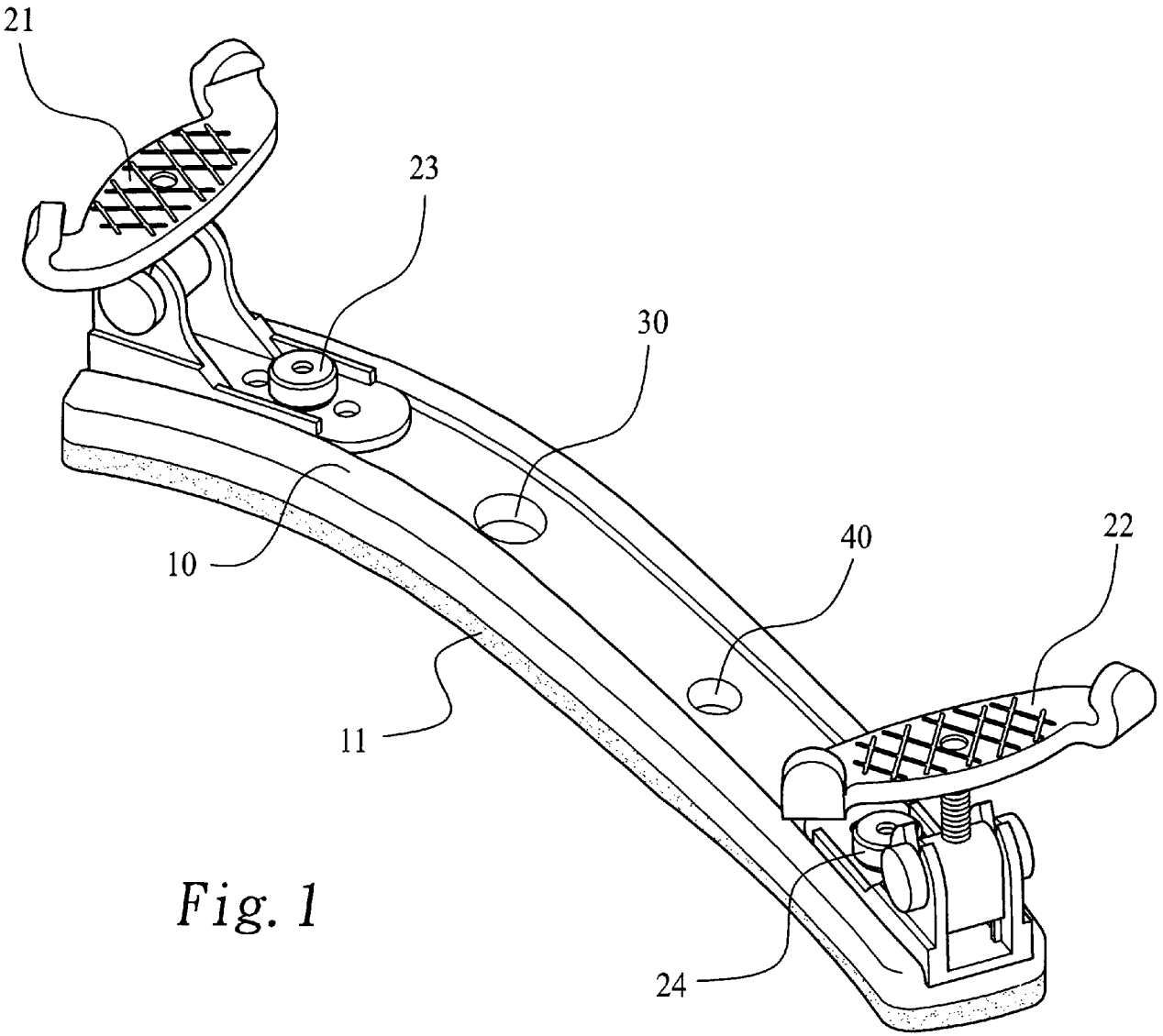
FIG. 1 is a perspective view of a shoulder rest for violin or the like according to a preferred embodiment of the present invention.

Please refer to FIG. 1 that is a top perspective view of a shoulder rest for a violin or the like according to a preferred embodiment of the present invention. As shown, the shoulder rest includes a substantially elongated base 10 made of a wooden material, and a layer of air-permeable soft pad 11 fixedly attached to a lower surface of the base 10. The elongated base 10 is provided at two upper outer ends with two spaced binding elements, namely, a first and a second binding element 21, 22. In the illustrated embodiment, the first and the second binding element 21, 22 are adjustable in position relative to the base 10. That is, the two binding elements 21 and 22 include adjusting bolts 23 and 24, respectively, which may be selectively locked to any two of one row of through holes provided along the base 10 and thereby locate the binding elements 21, 22 at differently spaced positions on the base 10.

The present invention is characterized in a plurality of through holes spaced along the elongated wooden base 10. In the illustrated embodiment, there are two spaced through holes 30, 40 provided on the base 10 to extend from the upper surface to the lower surface of the base 10. The through holes 30 and 40 have different diameters and are so located that they correspond to an outermost bass string and an outermost treble string, respectively, of a violin or the like. In the illustrated embodiment, the through hole 30 is diametrically larger than the through hole 40.

Figure 2:
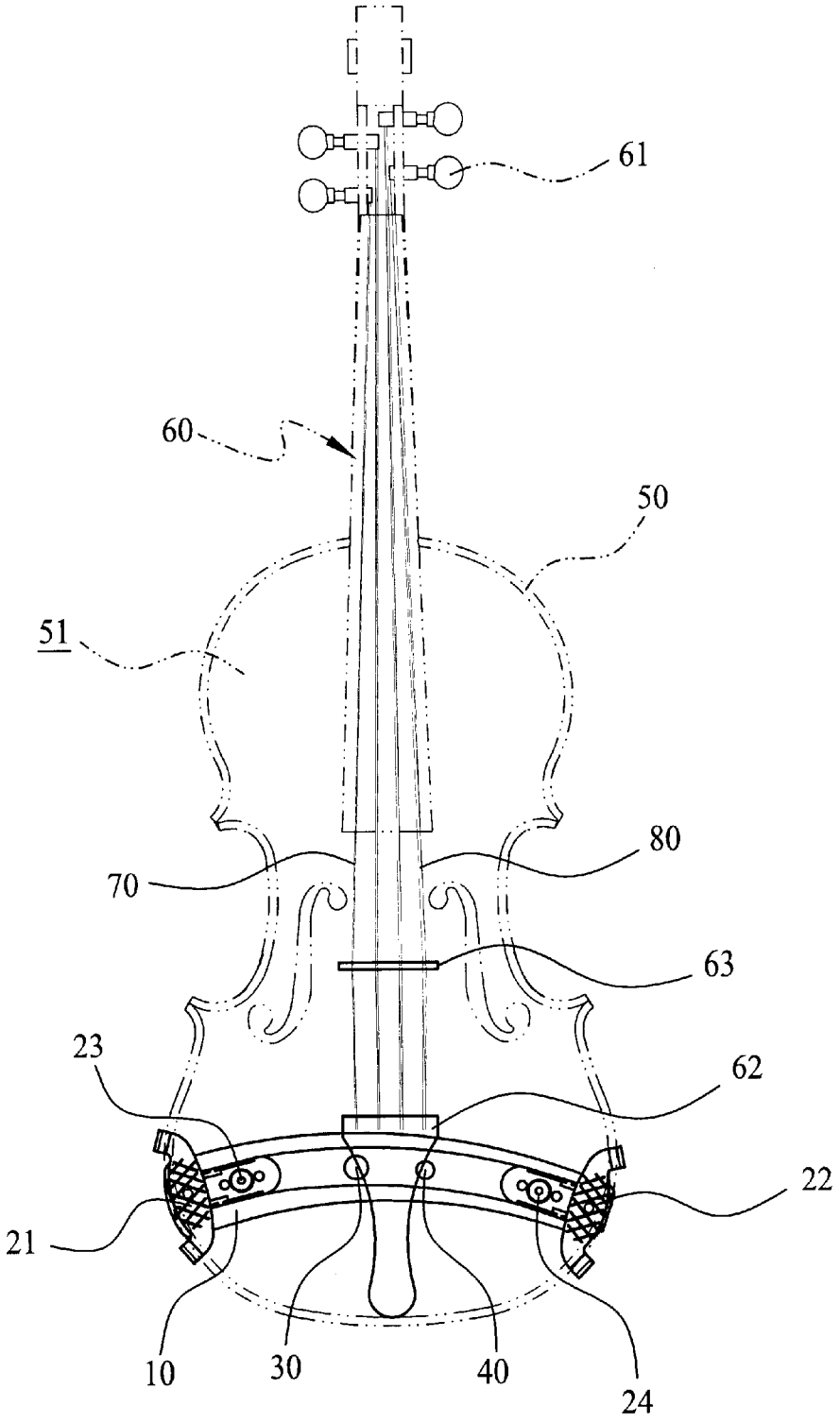
FIG. 2 shows the shoulder rest of FIG. 1 is fixed to a back of a violin, wherein a body of the violin is shown with dashed lines in order to show an upper surface of the shoulder rest.
Figure 3:
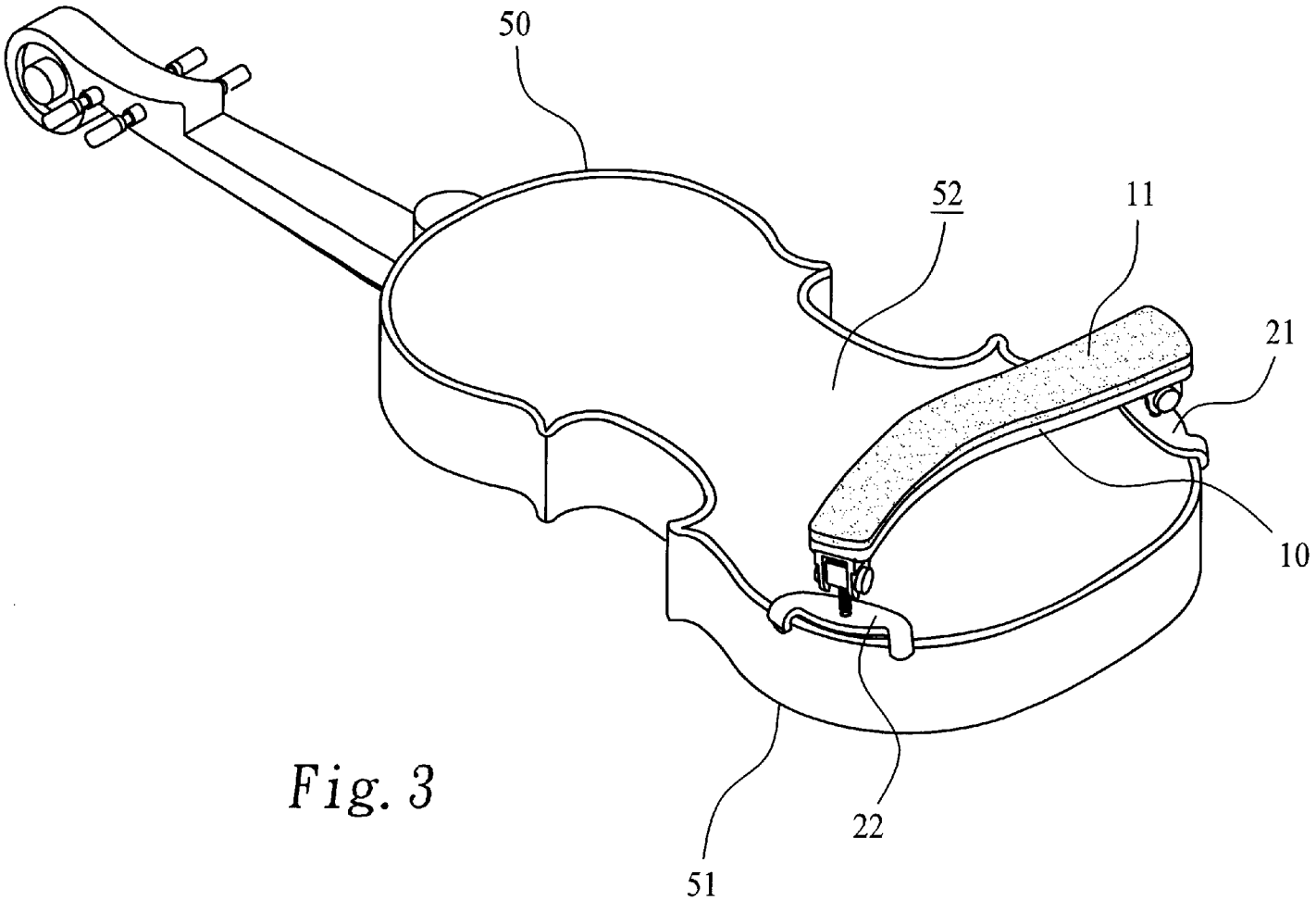
FIG. 3 is a rear view of FIG. 2.

FIGS. 2 and 3 shows the shoulder rest of the present invention as shown in FIG. 1 is connected to a general violin 50. The violin 50 includes a plurality of strings 60 provided at a top 51 thereof. The strings 60 are separately fixedly connected at respective front ends to tuning pegs 61 and at respective rear ends to a tailpiece 62. The strings 60 are also guided through a bridge 63 located on the top 51 at a predetermined point between the tuning pegs 61 and the tailpiece 62, so as to space from one another at the bridge 63 at fixed intervals. The shoulder rest of the present invention is fixed to a back 52 of the violin 50 by the first and second binding elements 21, 22 that have been adjusted and locked to corresponding outer edges of the body of the violin 50. At this point, all the strings 60 are located above the top 51 of the violin 50, and the large and small through holes 30, 40 pre-formed on the shoulder rest are correspondingly located below the back 52 of the violin 50 by a predetermined distance. Meanwhile, the shoulder rest is so located that the large and small through holes 30, 40 are located within an area below the strings 60.

Figure 4:
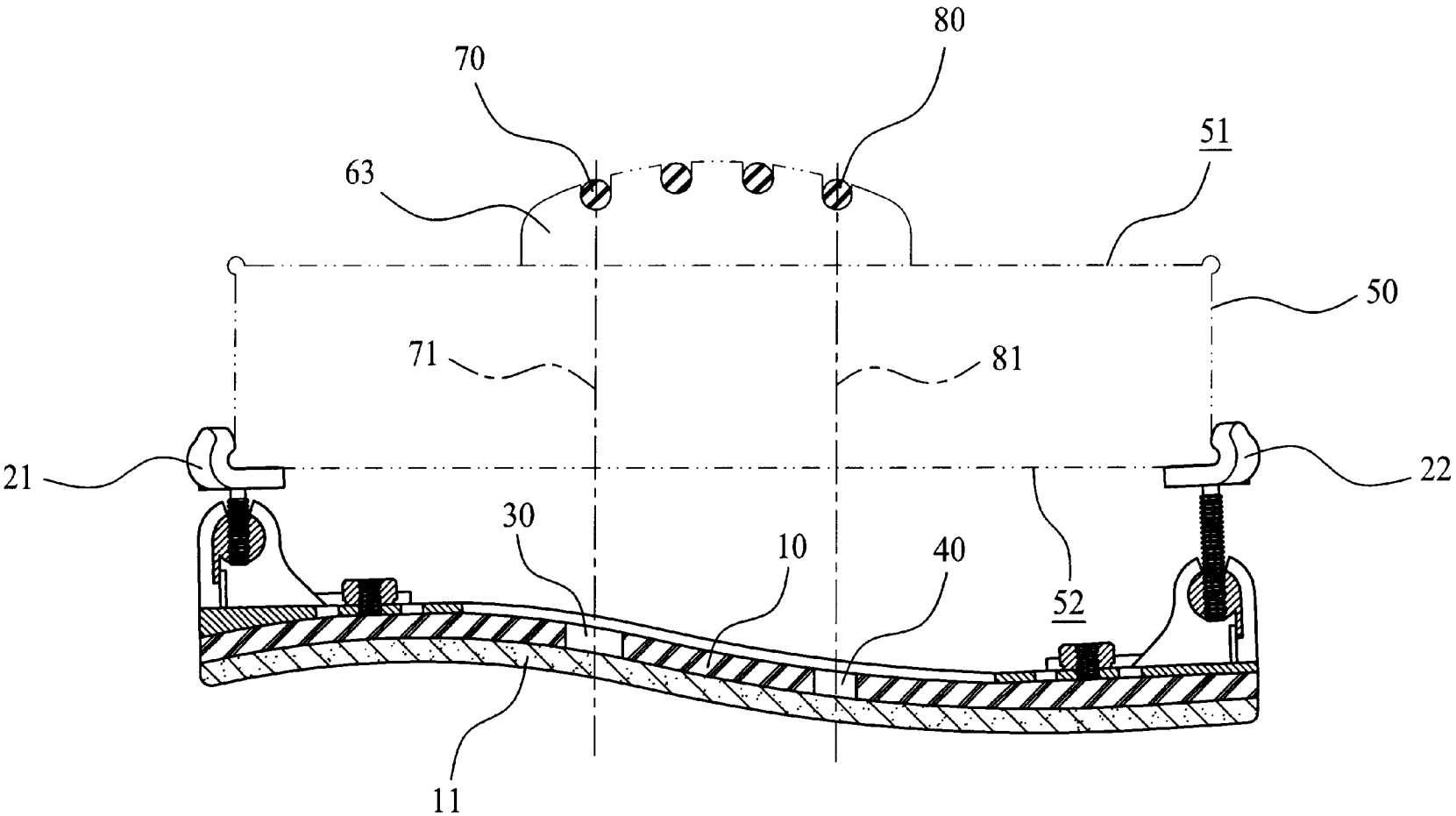
FIG. 4 is a cross sectional view of FIG. 2 showing the position of the shoulder rest relative to the violin.

Please refer to FIGS. 2 through 4 at the same time. In the present invention, the above-mentioned large through hole 30 is particularly located at a position below an outermost bass string 70, and the small through hole 40 below an outermost treble string 80. Although not always necessary, it is preferable vertical centerlines 71 and 81 of the outermost bass string 70 and the outermost treble string 80, respectively, pass centers of the large and small through holes 30 and 40, respectively, as shown in FIG. 4. That is, a center distance between the large and the small hole 30, 40 is preferably equal to a center distance between the outermost bass string 70 and the outermost treble string 80.

Diameters of the large and small through holes 30, 40 may be changed depending on different violins. However, it is always necessary for the through hole 30 corresponding to the outermost bass string 70 to be diametrically larger than the through hole 40 corresponding to the outermost treble string 80. In a feasible embodiment of the through holes 30, 40 implemented on a shoulder rest for a general violin, when the through hole 40 is set to 8 mm in diameter, the through hole 30 must be larger than 8 mm in diameter, and may be, for example, 10 mm.

With the differently sized through holes formed on the elongated base, the shoulder rest of the present invention is able to resonate with the strings of the violin or the like, and therefore makes the tone quality of musical sound produced by playing the violin or the like even more sonorous and sweeter and effectively upgrades the function of the violin or the like.

The present invention has been described with a preferred embodiment thereof and it is understood that many changes and modifications in the described embodiment can be carried out without departing from the scope and the spirit of the invention as defined by the appended claims.

What is claimed is:

1. A shoulder rest for violin or the like capable of improving tone quality, comprising at least an elongated base, and binding elements provided at two upper outer ends of said elongated base for fixing said elongated base to a back of a violin or the like; said elongated base being provided with a plurality of spaced and differently sized through holes corresponding to a plurality of bass and treble strings provided at a top of said violin or the like, and said through holes corresponding to said bass strings being diametrically larger than said through holes corresponding to said treble strings.

2. The shoulder rest for violin or the like capable of improving tone quality as claimed in claim 1, wherein said a plurality of through holes include two through holes of different diameters separately corresponding to an outermost one of said bass strings and an outermost one of said treble strings.

3. The shoulder rest for violin or the like capable of improving tone quality as claimed in claim 2, wherein a center distance between said two through holes is equal to a center distance between said outermost bass string and said outermost treble string.

* * * * *